US009453191B2

(12) United States Patent
van Deurzen et al.

(10) Patent No.: US 9,453,191 B2
(45) Date of Patent: Sep. 27, 2016

(54) POURABLE DETERGENT COMPOSITION COMPRISING ARYL SULFONATE SUSPENDED PARTICLES

(71) Applicant: Conopco, Inc., Englewood Cliffs, NJ (US)

(72) Inventors: Maria Petra J van Deurzen, Delfgauw (NL); Robert Jan Moll, Dordrecht (NL)

(73) Assignee: Conopco, Inc., Englewood Cliffs, NJ (US)

( * ) Notice: Subject to any disclaimer, the term of this patent is extended or adjusted under 35 U.S.C. 154(b) by 0 days.

(21) Appl. No.: 14/896,477

(22) PCT Filed: May 28, 2014

(86) PCT No.: PCT/EP2014/061125
§ 371 (c)(1),
(2) Date: Dec. 7, 2015

(87) PCT Pub. No.: WO2014/198547
PCT Pub. Date: Dec. 18, 2014

(65) Prior Publication Data

US 2016/0130534 A1 May 12, 2016

(30) Foreign Application Priority Data

Jun. 12, 2013 (EP) ..... 13171584

(51) Int. Cl.

| | |
|---|---|
| ***C11D 1/12*** | (2006.01) |
| ***C11D 1/22*** | (2006.01) |
| ***C11D 3/33*** | (2006.01) |
| ***C11D 3/386*** | (2006.01) |
| ***C11D 3/39*** | (2006.01) |
| ***C11D 3/395*** | (2006.01) |
| ***C11D 17/00*** | (2006.01) |
| ***C11D 1/14*** | (2006.01) |
| ***C11D 3/34*** | (2006.01) |

(52) U.S. Cl.
CPC ..... *C11D 17/003* (2013.01); *C11D 1/12* (2013.01); *C11D 1/146* (2013.01); *C11D 1/22* (2013.01); *C11D 3/33* (2013.01); *C11D 3/3418* (2013.01)

(58) Field of Classification Search
CPC ..... C11D 1/12; C11D 1/22; C11D 3/124; C11D 3/33; C11D 3/3418; C11D 3/386; C11D 3/39; C11D 3/3905; C11D 17/043; C11D 17/003; C11D 3/395; C11D 3/3956; C11D 9/446; C11D 11/0017; C11D 17/0004
See application file for complete search history.

(56) References Cited

U.S. PATENT DOCUMENTS

| | | | | |
|---|---|---|---|---|
| 4,648,987 | A | 3/1987 | Smith | |
| 4,797,231 | A | 1/1989 | Schumann | |
| 5,814,592 | A | 9/1998 | Kahn | |
| 2009/0264329 | A1 | 10/2009 | Underwood et al. | |
| 2010/0210501 | A1* | 8/2010 | Caggioni | C11D 3/222 510/338 |
| 2012/0021025 | A1* | 1/2012 | Bendejacq | A61K 8/0295 424/401 |

FOREIGN PATENT DOCUMENTS

| | | |
|---|---|---|
| DE | 10313453 | 10/2004 |
| EP | 0265979 | 6/1998 |
| EP | 0969080 | 10/2004 |
| EP | 2431452 | 3/2012 |
| JP | 2005179588 | 7/2005 |
| JP | 2009172709 | 8/2009 |
| WO | WO9321299 | 10/1993 |
| WO | WO9813467 | 4/1998 |
| WO | WO2006078074 | 7/2006 |
| WO | WO2006116099 | 11/2006 |
| WO | WO2007141527 | 12/2007 |

OTHER PUBLICATIONS

IPRP2 in PCTEP2014061125 dated Apr. 24, 2015.
Search Report in EP13171584 dated Nov. 20, 2013.
Search Report in PCTEP2014061125 dated Dec. 16, 2014.
Written Opinion in EP13171584 dated Nov. 20, 2013.
Written Opinion in PCTEP2014061125 dated Dec. 16, 2014.

* cited by examiner

*Primary Examiner* — Charles Boyer
(74) *Attorney, Agent, or Firm* — Rimma Mitelman

(57) ABSTRACT

The present invention relates to a pourable thixotropic detergent composition comprising a continuous phase and at least 0.3 wt. % of suspended particles comprising water-soluble surfactant, said continuous phase containing at least 10 wt. % of an aminocarboxylate chelant and at least 10 wt. % of water and said water-soluble surfactant being selected from aryl sulfonate surfactant, alkyl sulfate surfactant and combinations thereof. The pourable detergent composition offers the advantage that it does not exhibit significant demixing during storage.

14 Claims, 1 Drawing Sheet

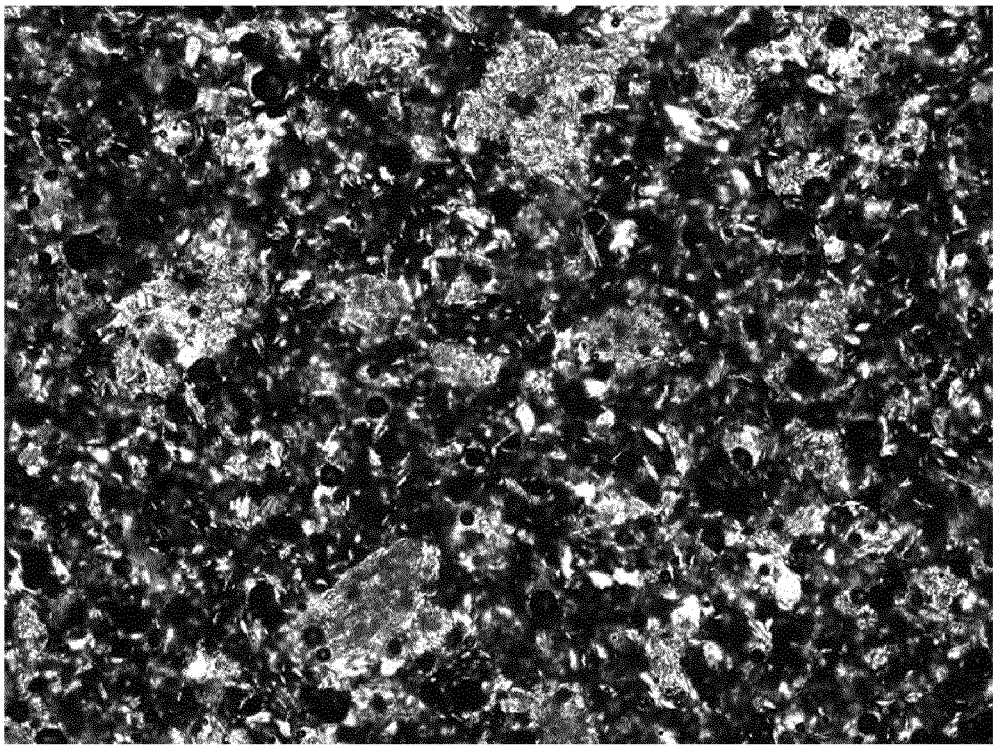

POURABLE DETERGENT COMPOSITION COMPRISING ARYL SULFONATE SUSPENDED PARTICLES

The present invention relates to a pourable detergent composition comprising a builder, water and particles of water-soluble surfactant. More particularly, the present invention relates to a pourable thixotropic detergent composition comprising a continuous phase and at least 0.3 wt. % of suspended particles comprising water-soluble surfactant, said continuous phase containing at least 10 wt. % of an aminocarboxylate chelant and at least 10 wt. % of water and said water-soluble surfactant being selected from aryl sulfonate surfactant, alkyl sulfate surfactant and combinations thereof.

The detergent composition of the present invention offers the advantage that it combines pourability with high thixotropic properties. Thixotropicity is desirable because it enables the production of storage stable pourable detergent compositions containing particulate detergent components such as bleach and enzyme granulate. The present detergent composition may be pourable as such, or it may be rendered pourable by subjecting to stress, e.g. by squeezing it out of a container. Examples of detergent compositions according to the present invention include dishwashing compositions, laundry detergents and hard surface cleaning compositions.

BACKGROUND OF THE INVENTION

Detergent formulations typically contain a number of different active components, including builders, surfactants, enzymes and bleaching agents.

Surfactants are employed to release stains and soil and to disperse the released components into the cleaning liquid. Enzymes help to remove stubborn stains of proteins, starch and lipids by hydrolyzing these components. Bleach is used to remove stains by oxidizing the components that make up these stains.

Calcium and magnesium ions have a negative effect on the removal of soils by detergent compositions. In order to negate these negative effects so called 'builders' (complexing agents) are commonly applied in detergent compositions.

Phosphorous based builders, such as phosphates, have been used for many years in a wide variety of detergent compositions. However, as part of an increasing trend towards environmentally friendly detergent compositions, alternative building agents have been developed and these alternative builders have found their way into commercial detergent products. Glutamic-N,N-diacetate (GLDA), methyl-glycine diacetate (MGDA) and citrate are examples of environmentally friendly builders that are used in commercial detergent products.

Liquid detergent formulations have been developed as these products offer the advantage over powdered formulations that they are easy to dose, may contain higher concentrations of active ingredients, suffer less from moisture spoilage during storage and/or are more easily dispersed into aqueous cleaning liquid. In order to provide liquid detergent compositions that deliver cleaning, spotting and filming performance similar to that of a powdered formulation it is necessary to include components that remain undissolved in the liquid product matrix. These undissolved components need to be homogeneously suspended throughout the product to guarantee a constant, optimum cleaning result. Although this may be achieved by instructing the user to shake the product before use, it is clearly preferable to provide the liquid detergent formulation in the form of a suspension that remains stable during the lifecycle of the product. This objective, however, is very difficult to achieve as suspensions demix over time because suspended particles are subject to sedimentation and creaming/floating phenomena.

WO 93/21299 describes a viscoelastic, thixotropic, liquid automatic dishwashing detergent composition comprising, by weight:

a) from 0.001% to 5% of an active detersive enzyme or enzymes;
b) from 0.1% to 10% of a viscoelastic, thixotropic thickener;
c) from 0.001% to 10% of an enzyme stabilizing system selected from the group consisting of calcium ion, propylene glycol, short chain carboxylic acid, polyhydroxyl compounds, boric acid, boronic acid and mixtures thereof;
d) from 0.01% to 40% of a detergent surfactant; and
e) sufficient pH adjusting agent, to provide said composition with a product pH between 7 and 11;

wherein said composition is characterized in that it is substantially free of chlorine bleach and silicate. The Examples of WO 93/21299 describe liquid aqueous detergent compositions that contain a builder (sodium citrate), enzymes and sodium cumene sulfate.

EP 2 431 452 describes a liquid cleaning composition comprising coloured cleaning particles as abrasives, wherein said coloured cleaning particles are selected from the group consisting of coloured nut shell particles, coloured stone particles, coloured particles derived from other plant parts, coloured wood particles and mixtures thereof, and wherein the liquid and the coloured cleaning particles have substantially same colour. The cleaning composition may comprise up to 10 wt % of chelating agents, such as aminocarboxylates. The cleaning composition may further contain from 0.01% to 50% anionic surfactants. Alkyl sulphonates, alkyl aryl sulphonates, alkyl sulphates, alkyl alkoxylated sulphate surfactants, $C_6$-$C_{20}$ alkyl alkoxylated linear or branched diphenyl oxide disulphonates are mentioned as examples of anionic surfactants.

US 2009/264329 describes a cleaner concentrate comprising:

a) one or more alkalinity sources present in an amount sufficient to provide a free alkalinity (expressed as $Na_2O$) of greater than about 3.6 wt %, based on the total weight of the cleaner concentrate, and a total alkalinity (expressed as $Na_2O$) of greater than about 6.1 wt %, based on the total weight of the cleaner concentrate;
b) one or more chelants present in an amount sufficient to permit a use of a water having a hardness number up to about 600 ppm (600 mg/L);
c) from about 0 wt % to about 39 wt % of one or more surfactants, based on the total weight of the cleaner concentrate; and
d) the remainder to 100 wt % of water, based on the total weight of the cleaner.

Dicarboxymethyl glutamic acid (GLDA) and methylglycine-N—N-diacetic acid (MGDA) are mentioned as examples of chelants. The use of hydrotropes in a concentration of up to 9 wt. % of the cleaner concentrate is mentioned. Examples of hydrotropes mentioned in the US patent application include cumenesulfonic acid, sodium salt.

It is an object of the present invention to provide a pourable detergent composition in the form of a suspension that is storage stable in that it does not exhibit significant demixing during storage.

SUMMARY OF THE INVENTION

The present inventors have unexpectedly discovered that the aforementioned objective can be realized by employing a specific combination of water, aminocarboxylate chelant and at least 0.3 wt. % of suspended particles comprising water-soluble surfactant, said continuous phase containing at least 10 wt. % of an aminocarboxylate chelant and at least 10 wt. % of water and said water-soluble surfactant being selected from aryl sulfonate surfactant, alkyl sulfate surfactant and combinations thereof.

Although the inventors do not wish to be bound by theory, it is believed that the aminocarboxylate chelant in the present composition binds the water contained therein so strongly that at least a part of the water can no longer act as a solvent for the water-soluble surfactant. As a result, a fraction of the water-soluble surfactant is present in the form of suspended particles, said suspended particles imparting viscosity as well as thixotropic properties to the detergent composition.

Generally, thixotropic compositions are highly viscous in a quiescent state but when subjected to a shear, e.g when shaken or squeezed through an orifice, these compositions become less viscous and flow more easily. Thixotropic detergent compositions have the advantage that the high viscosity under quiescent conditions contributes to the suspension stability, whereas the viscosity reduction under the influence of shear stress facilitates dispensing of the detergent composition from a container, e.g. a squeezable bottle.

The detergent composition of the present invention offers the advantages that it is easy to dose and that it is stable upon storage despite the fact that it contains suspended particles. As a matter of fact, the suspended surfactant-containing particles enhance the suspension stability of the detergent composition and enable the manufacture of storage stable pourable detergent compositions that contain additional particulate components, such as enzyme granulates or encapsulated bleaching agents.

DEFINITIONS

The term "thixotropic" as used herein refers to compositions (e.g. gels or fluids) that are viscous under quiescent conditions and that become less viscous when shaken, agitated, or otherwise stressed. In thixotropic compositions, this so called "shear thinning effect" is reversible, i.e. the composition will return to a more viscous state once it is no longer subjected to shear stress.

The term "pourable" as used herein refers to a composition that is able to flow under ambient conditions. Thixotropic compositions that can be rendered pourable by shear thinning are also regarded as pourable.

The term "particles" as used herein, unless indicated otherwise, refers to a particulate matter in liquid or solid form, preferably solid form.

The terminology "transiently suspended particles" as used herein refers to particles that are suspended within the continuous phase, but which are separated from said continuous phase when the detergent composition is centrifuged at 1500 G for 5 minutes, using the procedure described herein.

The term "surfactant" as used herein refers to a substance that is capable of lowering the surface tension of a liquid, the interfacial tension between two liquids, or that between a liquid and a solid. The term "surfactant" encompasses hydrotropes.

The term "water soluble" in relation to the surfactant as described herein means a solubility in distilled water of 20° C. of at least 0.01 mol/L, preferably of at least 0.1 mol/L.

The term "aryl sulfonate" encompasses aryl sulfonic acid as well as salts thereof. Likewise, the term "alkyl sulfate" encompasses alkyl sulfuric acid as well as salts thereof.

The term "aminocarboxylate chelant" as used herein refers to compounds containing one or more nitrogen atoms connected through carbon atoms to one or more carboxyl groups, which form strong complexes with metal ions by donation of electron pairs from the nitrogen and oxygen atoms to the metal ion to form multiple chelate rings.

Whenever reference is made herein to water content, unless indicated otherwise, said water content includes unbound (free) as well as bound water.

Whenever a parameter, such as a concentration or a ratio, is said to be less than a certain upper limit it should be understood that in the absence of a specified lower limit the lower limit for said parameter is 0.

Whenever an amount or concentration of a component is quantified herein, unless indicated otherwise, the quantified amount or quantified concentration relates to said component per se, even though it may be common practice to add such a component in the form of a solution or of a blend with one or more other ingredients.

The term "comprising" is used herein in its ordinary meaning and means including, made up of, composed of, consisting and/or consisting essentially of. In other words, the term is defined as not being exhaustive of the steps, components, ingredients, or features to which it refers.

DETAILED DESCRIPTION OF THE INVENTION

Accordingly, one aspect of the present invention relates to a pourable thixotropic detergent composition comprising a continuous phase and at least 0.3 wt. % of suspended particles comprising water-soluble surfactant, said continuous phase containing at least 10 wt. % of an aminocarboxylate chelant and at least 10 wt. % of water and said water-soluble surfactant being selected from aryl sulfonate surfactant, alkyl sulfate surfactant and combinations thereof.

The thixotropic detergent composition of the present invention preferably is a pourable composition. The composition may be pourable as such or it may be rendered pourable by subjecting it to shear thinning. Most preferably, the composition is pourable as such.

The detergent composition of the present invention preferably exhibits substantial shear thinning in that the viscosity of the composition at 20° C. and 500 Pa (shear stress) is at least 2 times lower than the viscosity at 20° C. and 2 Pa. Even more preferably, the viscosity at 20° C. and 500 Pa is at least 5 times, most preferably at least 10 times lower than the viscosity at 20° C. and 2 Pa. The viscosity is suitably determined using an Anton Paar Modulair Compact Rheometer (MCR302) using the following set-up and procedure:

Geometry:

Plate—Plate (50 mm sandblasted Plate & -Spindle)

Peltier: PTD200/Air

Temperature: 25° C.

Gap-size: at least 1 mm (if distortion of the measurement by particles is observed, the gap-size can be increased to counter this effect, to a maximum of 3.5 mm)

Parameters in the Rheoplus Software:

Oscillation measurement with a frequency of 10 mHz at a constant strain of 10% measuring the storage- and loss modulus (G' and G"). Duration of this step is 5 minutes in total.

Rotation measurement, a ramp log profile with a Torque from 0.2 to 12.2 mNm during 15 minutes plotting the viscosity (Pa·s) as a function of shear stress (Pa).

Procedure

Equilibrate sample for 30 minutes prior to measurement

Trim sample just before reaching the measuring position

Preferably the aminocarboxylate chelant is selected from glutamic acid N,N-diacetic acid (GLDA), methylglycinediacetic acid (MGDA), iminodisuccinic acid (IDS), ethylenediaminetetraacetic acid (EDTA) diethylenetriaminepentaacetic acid (DTPA), hydroxyethyliminodiacetic acid (HEIDA), Nitrilotriacetic acid (NTA), aspartic acid diethoxysuccinic acid (AES), aspartic acid-N,N-diacetic acid (ASDA), hydroxyethylenediaminetetraacetic acid (HEDTA), hydroxyethylethylenediaminetriacetic acid (HEEDTA), iminodifumaric (IDF), iminoditartaric acid (IDT), iminodimaleic acid (IDMAL), iminodimalic acid (IDM), ethylenediaminedifumaric acid (EDDF), ethylenediaminedimalic acid (EDDM), ethylenediamineditartaric acid (EDDT), ethylenediaminedisuccinic acid (EDDS), ethylenediaminedimaleic acid and (EDDMAL), dipicolinic acid, their salts, and combinations thereof.

More preferably, the aminocarboxylate chelant is selected from GLDA, MGDA, IDS, HEIDA, EDDS and NTA. In an even more preferred embodiment, the aminocarboxylate chelant is selected from GLDA, MGDA, IDS and combinations thereof. The inventors have found that GLDA is particularly useful as this chelant is capable of reducing the water activity of the detergent composition very effectively. Consequently, in according with a particularly preferred embodiment the aminocarboxylate chelant is GLDA.

The present composition preferably contains 20-75% of the aminocarboxylate chelant by weight of the continuous phase. Even more preferably, the composition contains 25-70% and most preferably 30-65% of the aminocarboxylate chelant by weight of the continuous phase.

Together, the aminopolycarboxylate chelant and water typically represent at least 60 wt. %, more preferably at least 70 wt. % and most preferably at least 80 wt. % of the continuous phase of the present composition.

The water content of the present composition preferably lies in the range of 10-70 wt. %, more preferably of 15-65 wt. % and most preferably of 25-60 wt. %.

The water content of the present composition expressed by weight of the continuous phase preferably lies in the range of 15-80 wt. %, more preferably 25-70 wt. % and most preferably 30-65 wt. %.

The water activity ($A_w$) of the detergent composition typically does not exceed 0.85. Preferably, it does not exceed 0.75, most preferably it does not exceed 0.6. As explained herein before, very low water activities can be realized by using GLDA. The water activity of the composition is preferably larger than 0.2, more preferably larger than 0.3. The water activity of the composition may suitably be determined by a Novasina labmaster conditioned $A_w$ measuring device that is set at 25° C. and measured until stable.

The stability of the present composition is dependent on the water/aminocarboxylate chelant balance of the product, especially if the composition contains added particulate detergent components such as bleach powder or enzyme granulate. Advantageously, the present composition contains aminocarboxylate chelant and water in a weight ratio of aminocarboxylate chelant to water that lies within the range of 2:5 to 5:1.

In case the aminocarboxylate chelant is GLDA, the weight ratio of aminocarboxylate chelant to water preferably lies within the range of 7:10 to 3:1, more preferably of 9:10 to 5:2; and most preferably of 1:1 to 5:3.

In case the aminocarboxylate chelant is composed of MDGA and/or IDS, the weight ratio of aminocarboxylate chelant to water preferably lies within the range of 2:5 to 1:1, most preferably with the range of 1:2 to 3:4.

Suitable aryl sulfonate surfactants for use according to the invention are alkyl phenyl sulfonates, especially $C_1$-$C_5$ alkyl phenyl sulfonates.

Suitable alkyl sulfate surfactants for use according to the invention are $C_8$-$C_{18}$ alkyl sulfates, especially linear $C_8$-$C_{18}$ alkyl sulfates. Even more preferably the alkyl sulfate surfactant is a linear $C_{10}$-$C_{14}$ alkyl sulfate. A particularly preferred alkyl sulfate surfactant is sodium dodecyl sulfate (SDS).

Preferred water-soluble surfactants for use according to the invention are cumene sulfonate, xylene sulfonate, toluene sulfonate and combinations thereof. A particularly preferred water-soluble surfactant is sodium cumene sulfonate.

The benefits of the invention are particularly pronounced when the detergent composition contains 0.5-40 wt. %, more preferably 0.7-20 wt. % and most preferably 1-10 wt. % of the water-soluble surfactant, all percentages being calculated by weight of the total composition.

The water-soluble surfactant may be present in the detergent composition in the form of particles that consist of the water-soluble surfactant. However, at least a part of the water-soluble surfactant may also be contained in particles that contain additional components. Such mixed particles may be formed, for instance, if co-precipitation occurs during the manufacture of the detergent composition. Furthermore, particles of different composition may form aggregated particles. Typically, the present composition contains appreciable levels of suspended particles that largely consist of the water-soluble surfactant.

Preferably, the composition contains at least 1 wt. %, more preferably at least 5 wt. % and most preferably 10-40 wt. % of suspended particles having a diameter in the range of 10-3000 μm. These percentages include suspended particles comprising water-soluble surfactant as well as suspended particles made up of other components.

In another preferred embodiment, at least 80 wt. % of suspended particles have a diameter in the range of 10-3000 μm, more preferably in the range of 20-2500 μm and most preferably in the range of 30-2000 μm.

The diameter distribution of the suspended particles in the detergent composition is suitably determined by means of light microscopy using polarised light and image analysis. The detection limit of this technique is around 1 μm. A description of this particle size analysis method is provided below.

As explained herein before, the detergent compositions of the present invention offer the important advantage that particulate components, such as bleach particles or enzyme granulate, can be incorporated in the composition as suspended particles and that these particles will remain in suspension for a prolonged time thanks to the presence of the suspended particles of water-soluble surfactant. Thus, the present invention makes it possible to substantially improve the storage stability of pourable detergent compositions in the form of suspensions that are inherently unstable, i.e. that show a tendency to demix during storage.

Centrifugation can suitably be used to analyse the intrinsic stability of suspensions. Particles that separate out during centrifugation and end up in the sediment or in a top layer will usually also tend to separate out during prolonged storage. For ease of reference, suspended particles that are contained in a suspension and that separate out during centrifugation are referred to herein as "transiently suspended particles".

The concentration of "transiently suspended particles" within the present detergent composition is determined by centrifuging the composition at 1,300 G for 5 minutes using the following procedure:

- introduce 16 grams of a sample (having a temperature of 20° C.) in a cylindrical centrifuge tube having an internal diameter of 1.5 cm;
- centrifuge the sample at 1,300 G for 0.5 minutes;
- carefully separate sediment and top layer and determine the combined weight of these fractions;
- calculate the weight percentage of the original sample that is represented by the sediment fraction.

If the amount of sediment is too low to enable an accurate determination, the same procedure should be repeated using a larger amount of sample and a bigger centrifuge tube.

The present composition advantageously contains an appreciable amount of transiently suspended particles. Preferably, the composition contains at least 1 wt. %, more preferably at least 5 wt. % and most preferably 10-40 wt. % of transiently suspended particles. The transiently suspended particles can include particles comprising water-soluble surfactant. However, typically, the detergent composition contains an appreciable amount of particles of water-soluble surfactant that do not qualify as transiently suspended particles. The ability of suspended particles comprising water-soluble surfactant to remain in suspension even when subjected to a high G-forces serves so show that these particles can contribute to suspension stability.

The transiently suspended particles preferably comprise one or more detergent ingredients selected from bleach, enzyme, surfactant, silica, bleach activator, bleach catalyst, dispersing polymer, glass corrosion inhibitor, carbonate salt, silicate salt. Even more preferably, the transiently suspended particles contain at least 70 wt. %, more preferably at least 80 wt. % and most preferably at least 90 wt. % of said one or more detergent ingredients The present composition offers the advantage that despite the presence of suspended surfactant particles, the composition remains very stable. Accordingly, the composition of the invention has a colloidal stability as determined by a sedimentation height of less than 1 mm after 24 hours, preferably less than 0.5 mm after 24 hours. The colloidal stability is suitably determined by employing the stability test described in the Examples.

The detergent composition of the present invention preferably can be removed from a container by simple pouring. Accordingly, the composition preferably exhibits flowing behaviour. Typically, the composition of the present invention has a flowability of at least 40%. As used herein, the term "flowability" refers to the weight percentage of the composition that is able to flow out of a funnel over a period of 10 minutes under the influence of gravity, using the test described in the Examples.

Preferably the detergent composition of the invention, when added to demineralised water having a temperature of 20° C. in a concentration of 1 g per 100 ml of water, yields an aqueous solution having a pH of 7-13, preferably of 8-12, most preferably of 9-11.4.

Examples of detergent compositions encompassed by the present invention include dishwashing compositions, laundry detergents, rim blocks and hard surface cleaning compositions. According to a particularly preferred embodiment, the detergent composition is a dishwashing composition, especially a machine dishwashing composition.

Silica

In order to further improve the suspension stability of the detergent composition of the invention, the composition may suitably contain 0.5-5.0 wt. % silica. The silica material may be selected from amorphous silica, precipitated, fumed silica, gel-formation formed silica and mixtures thereof.

Preferably, the water-soluble surfactant and the silica together constitute at least 2 wt. %, more preferably at least 3 wt. % of the detergent composition.

The composition of the invention may suitably contain one or more acids dissolved in the continuous phase. Typically, the continuous phase contains 0.1-10 wt. % of dissolved acid. In a preferred embodiment, the dissolved acid is selected from sulphuric acid, citric acid and combinations thereof.

Other Surfactants

The present detergent composition preferably contains one or more surfactants other than aryl sulfonates or alkyl sulfates.

According to a particularly preferred embodiment, the detergent composition contains 0.1-15 wt. %, more preferably 0.5-10 wt. % and most preferably 1-5 wt. % of a nonionic surfactant or a mixture of two or more non-ionic surfactants.

Examples of nonionic surfactants that may be employed in the present composition include the condensation products of hydrophobic alkyl, alkenyl, or alkyl aromatic compounds bearing functional groups having free reactive hydrogen available for condensation with hydrophilic alkylene oxide, such as ethylene oxide, propylene oxide, butylene oxide, polyethylene oxide or polyethylene glycol to form nonionic surfactants. Examples of such functional groups include hydroxy, carboxy, mercapto, amino or amido groups.

Examples of useful hydrophobes of commercial nonionic surfactants include $C_8$-$C_{18}$ alkyl fatty alcohols, $C_8$-$C_{14}$ alkyl phenols, $C_8$-$C_{18}$ alkyl fatty acids, $C_8$-$C_{18}$ alkyl mercaptans, $C_8$-$C_{18}$ alkyl fatty amines, $C_8$-$C_{18}$ alkyl amides and $C_8$-$C_{18}$ alkyl fatty alkanolamides. Accordingly, suitable ethoxylated fatty alcohols may be chosen from ethoxylated cetyl alcohol, ethoxylated ketostearyl alcohol, ethoxylated isotridecyl alcohol, ethoxylated lauric alcohol, ethoxylated oleyl alcohol and mixtures thereof.

Examples of suitable nonionic surfactants for use in the invention are found in the low- to non-foaming ethoxylated/propoxylated straight-chain alcohols of the Plurafac™ LF series, supplied by the BASF and the Synperonic™ NCA series supplied by Croda. Also of interest are the end-capped ethoxylated alcohols available as the SLF 18 series from BASF and the alkylpolyethylene glycol ethers made from a linear, saturated $C_{16}$-$C_{18}$ fatty alcohol of the Lutensol™ AT series, supplied by BASF. Other suitable nonionics to apply in the composition of the invention are modified fatty alcohol polyglycolethers available as Dehypon™ 3697 GRA or Dehypon™ Wet from BASF/Cognis. Also suitable for use herein are nonionics from the Lutensol™ TO series of BASF, which are alkylpolyethylene glycol ethers made from a saturated iso-$C_{13}$ alcohol.

Amineoxide surfactants may also be used in the present invention as anti-redeposition surfactant. Examples of suitable amineoxide surfactants are $C_{10}$-$C_{18}$ alkyl dimethylamine oxide and $C_{10}$-$C_{18}$ acylamido alkyl dimethylamine oxide.

Bleach

The present detergent composition preferably contains bleach particles. Although the inventors do not wish to be bound by theory, it is believed that the aminocarboxylate chelant in the present composition, especially GLDA, binds the water contained therein so strongly that the water can no longer exert a destabilising effect on the bleach particles.

Typically, the detergent composition contains at least 0.3 wt. %, preferably at least 2 wt. % and most preferably at least 6 wt. % of bleach particles by total weight of the composition.

The bleach particles of the present composition may suitably comprise a chlorine-, or bromine-releasing agent or a peroxygen compound. Preferably, the bleach particles of the present composition comprise a bleaching agent selected from peroxides (including peroxide salts such as sodium percarbonate), organic peracids, salts of organic peracids and combinations thereof. More preferably, the bleaching agent is a peroxide. Most preferably, the bleaching agent is a percarbonate.

Examples of peroxides are acids and corresponding salts of monopersulphate, perborate monohydrate, perborate tetrahydrate, and percarbonate.

Organic peracids useful herein include alkyl peroxy acids and aryl peroxyacids such as peroxybenzoic acid and ring-substituted peroxybenzoic acids (e.g. peroxy-alpha-naphthoic acid), aliphatic and substituted aliphatic monoperoxy acids (e.g. peroxylauric acid and peroxystearic acid), and phthaloyl amido peroxy caproic acid (PAP).

Typical diperoxy acids useful herein include alkyl diperoxy acids and aryldiperoxy acids, such as 1,12-di-peroxydodecanedioic acid (DPDA), 1,9-diperoxyazelaic acid, diperoxybrassylic acid, diperoxysebacic acid and diperoxyisophthalic acid, and 2-decyldiperoxybutane-1,4-dioic acid.

The present detergent composition offers the advantage that despite the high water content, the bleach particles remain very stable. Typically, bleach activity of a freshly prepared composition according to the present invention decreases by not more than 70%, more preferably by not more than 50% and most preferably by not more than 20% when the composition is stored in a closed container for 8 weeks at 20° C. Bleach activity may suitably be determined by iodometric titration. In this titration a suitable amount of detergent sample is dissolved in acidified water containing a molybdate catalyst. Subsequently potassium iodide is added to an aliquot of the solution. The iodine liberated by the bleach is titrated with sodium thiosulphate solution.

According to a preferred embodiment, the present composition comprises coated bleach particles. According to a particularly preferred embodiment, the coated bleach particles comprise a water-soluble coating. The water-soluble coating advantageously comprises a coating agent selected from alkali sulphate, alkali carbonate or alkali chloride and combinations thereof.

The coating of the bleaching agent can be done by, for example, crystallisation or by spray granulation. Suitable coated bleaching agents are described in, for example, EP-A 0 891 417, EP-A 0 136 580 and EP-A 0 863 842. The use of spray granulated coated percarbonate is most preferred.

The detergent composition may contain one or more bleach activators such as peroxyacid bleach precursors. Peroxyacid bleach precursors are well known in the art. As non-limiting examples can be named N,N,N',N'-tetraacetyl ethylene diamine (TAED), sodium nonanoyloxybenzene sulphonate (SNOBS), sodium benzoyloxybenzene sulphonate (SBOBS) and the cationic peroxyacid precursor (SPCC) as described in U.S. Pat. No. 4,751,015.

If desirable, a bleach catalyst, such as the manganese complex, e.g. Mn-Me TACN, as described in EP-A-0458397, or the sulphonimines of U.S. Pat. No. 5,041,232 and U.S. Pat. No. 5,047,163, can be incorporated. This bleach catalyst may suitably be present in the composition in the form of an encapsulate, notably an encapsulate that is separate from the bleach particles (to avoid premature bleach activation). Cobalt or iron catalysts can also be used.

Enzymes

The high suspension stability of the composition of the invention makes it possible to incorporate enzymes in the composition without the composition suffering from segregation or degradation of the enzymes. Hence, in a preferred embodiment of the invention, the composition comprises one or more enzymes, preferably in the form of a powder, granulate or encapsulate.

Examples of enzymes suitable for use in the compositions of this invention include lipases, cellulases, peroxidases, proteases (proteolytic enzymes), amylases (amylolytic enzymes) and others which degrade, alter or facilitate the degradation or alteration of biochemical soils and stains encountered in cleansing situations so as to remove more easily the soil or stain from the object being washed to make the soil or stain more removable in a subsequent cleansing step. Both degradation and alteration can improve soil removal.

Well-known and preferred examples of these enzymes are proteases, amylases, cellulases, peroxidases, mannanases, pectate lyases and lipases and combinations thereof. The enzymes most commonly used in detergent compositions are proteolytic and amylolytic enzymes.

In a preferred embodiment of this invention the enzymes are present in encapsulated form. Well know enzyme stabilizers such as polyalcohols/borax, calcium, formate or protease inhibitors like 4-formylphenyl boronic acid may also be present in the composition The proteolytic enzymes in this invention include metalloproteases and serine proteases, including neutral or alkaline microbial serine protease, such as subtilisins (EC 3.4.21.62). The proteolytic enzymes for use in the present invention can be those derived from bacteria of fungi. Chemically or genetically modified mutants (variants) are included. Preferred proteolytic enzymes are those derived from *Bacillus*, such as *B. lentus, B. gibsonii, B. subtilis, B. licheniformis, B. alkalophilus, B. amyloliquefaciens* and *Bacillus pumilus*, of which *B. lentus* and *B. gibsonii* are most preferred. Examples of such proteolytic enzymes are Excellase™, Properase™, Purafect™, Purafect™ Prime, Purafect™ Ox by Genencor; and those sold under the trade names Blazem™, Ovozymem™, Savinase™, Alcalase™, Everlase™, Esperase™, Relase™, Polarzyme™, Liquinase™ and Coronase™ by Novozymes.

Preferred levels of protease in the present composition are from 0.1 to 10, more preferably from 0.2 to 5, most preferably 0.4 to about 4 mg active protease per gram of composition.

The amylolytic enzymes for use in the present invention can be those derived from bacteria or fungi. Chemically or genetically modified mutants (variants) are included. Preferred amylolytic enzyme is an alpha-amylase derived from a strain of *Bacillus*, such as *B. subtilis, B. licheniformis, B. amyloliquefaciens* or *B. stearothermophilus*. Examples of such amylolytic enzymes are produced and distributed under the trade name of Stainzyme™, Stainzyme™ Plus, Termamyl™, Natalase™ and Duramyl™ by Novozymes; as well as Powerase™, Purastar™, Purastar™ Oxam by Genencor. Stainzyme™, Stainzyme™ Plus and Powerase™ are the preferred amylases.

Preferred levels of amylase in the present composition are from 0.01 to 5, more preferably from 0.02 to 2, most preferably from 0.05 to about 1 mg active amylase per gram of composition.

The enzymes may suitably be incorporated in the detergent composition in liquid or in encapsulated form. In case the composition has a pH of 9.0 and more it is preferred to employ enzymes in encapsulated form.

Examples of encapsulated forms are enzyme granule types D, E and HS by Genencor and granule types, T, GT, TXT and Evity™ of Novozymes.

In case the pH is less than 9.0 it can be advantageous to employ non-encapsulated enzymes.

Other Ingredients

In a preferred embodiment of the current invention, the detergent composition furthermore comprises at least one dispersing polymer. Dispersing polymers as referred to in this invention are chosen from the group of anti-spotting agents and/or anti-scaling agents.

Examples of suitable anti-spotting polymeric agents include hydrophobically modified polycarboxylic acids such as Acusol™ 460 ND (ex Dow) and Alcosperse™ 747 by AkzoNobel, whereas also synthetic clays, and preferably those synthetic clays which have a high surface area are very useful to prevent spots, in particular those formed where soil and dispersed remnants are present at places where the water collects on the glass and spots formed when the water subsequently evaporates.

Examples of suitable anti-scaling agents include organic phosphonates, amino carboxylates, polyfunctionally-substituted compounds, and mixtures thereof. Particularly preferred anti-scaling agents are organic phosphonates such as ⇨ -hydroxy-2 phenyl ethyl diphosphonate, ethylene diphosphonate, hydroxy 1,1-hexylidene, vinylidene 1,1-diphosphonate, 1,2-dihydroxyethane 1,1-diphosphonate and hydroxy-ethylene 1,1-diphosphonate. Most preferred is hydroxy-ethylene 1,1-diphosphonate (EDHP) and 2-phosphono-butane, 1,2,4-tricarboxylic acid (Bayhibit ex Bayer).

Suitable anti-scaling agents are water soluble dispersing polymers prepared from an allyloxybenzenesulfonic acid monomer, a methallyl sulfonic acid monomer, a copolymerizable nonionic monomer and a copolymerizable olefinically unsaturated carboxylic acid monomer as described in U.S. Pat. No. 5,547,612 or known as acrylic sulphonated polymers as described in EP 851 022. Polymers of this type include polyacrylate with methyl methacrylate, sodium methallyl sulphonate and sulphophenol methallyl ether such as Alcosperse™ 240 supplied (AkzoNobel). Also suitable is a terpolymer containing polyacrylate with 2-acrylamido-2 methylpropane sulphonic acid such as Acumer 3100 supplied by Dow. As an alternative, polymers and co-polymers of acrylic acid having a molecular weight between 500 and 20,000 can also be used, such as homo-polymeric polycarboxylic acid compounds with acrylic acid as the monomeric unit. The average weight of such homo-polymers in the acid form preferably ranges from 1,000 to 100,000 particularly from 3,000 to 10,000 e.g. Sokolan™ PA 25 from BASF or Acusol™ 425 from Dow.

Also suitable are polycarboxylates co-polymers derived from monomers of acrylic acid and maleic acid, such as CP 5 from BASF. The average molecular weight of these polymers in the acid form preferably ranges from 4,000 to 70,000. Modified polycarboxylates like Sokalan™CP42, Sokalan™ CP50 from BASF or Alcoguard™ 4160 from AkzoNobel may also be used.

Mixture of anti-scaling agents may also be used. Particularly useful is a mixture of organic phosphonates and polymers of acrylic acid.

It is preferable if the level of dispersing polymers ranges from 0.2 to 10 wt. % of the total composition, preferably from 0.5 to 8 wt. %, and further preferred from 1 to 6 wt. %.

Glass corrosion inhibitors can prevent the irreversible corrosion and iridescence of glass surfaces in machine dishwash detergents. The claimed composition may suitably contain glass corrosion inhibitors. Suitable glass corrosion agents can be selected from the group the group consisting of salts of zinc, bismuth, aluminum, tin, magnesium, calcium, strontium, titanium, zirconium, manganese, lanthanum, mixtures thereof and precursors thereof. Most preferred are salts of bismuth, magnesium or zinc or combinations thereof. Preferred levels of glass corrosion inhibitors in the present composition are 0.01-2 wt. %, more preferably 10.01-0.5 wt. %.

Anti-tarnishing agents may prevent or reduce the tarnishing, corrosion or oxidation of metals such as silver, copper, aluminium and stainless steel. Anti-tarnishing agents such as benzotriazole or bis-benzotriazole and substituted or substituted derivatives thereof and those described in EP 723 577 (Unilever) may also be included in the composition. Other anti-tarnishing agents that may be included in the detergent composition are mentioned in WO 94/26860 and WO 94/26859. Suitable redox active agents are for example complexes chosen from the group of cerium, cobalt, hafnium, gallium, manganese, titanium, vanadium, zinc or zirconium, in which the metal are in the oxidation state of II, II, IV V or VI.

The present composition may suitably contain a non-surfactant, water-soluble, liquid binder, e.g. in a concentration of 0-50% by weight of the continuous phase. Examples of such liquid binders include polyethylene glycols, polypropylene glycols, glycerol, glycerol carbonate, ethylene glycol, propylene gylcol and propylene carbonate.

Optionally other components may be added to the formulation such as perfume, colorant or preservatives.

Another aspect of the invention relates to a method of preparing a composition according to any one of the preceding claims, said method comprising:

- providing a liquid mixture containing water and aminocarboxylate chelant;
- mixing water-soluble surfactant with the liquid mixture to produce a thixotropic liquid mixture; and
- optionally, mixing one or more particulate detergent components into the thixotropic liquid mixture.

The liquid mixture typically provides at least 80 wt. % of the water and at least 80 wt. % of the aminocarboxylate chelant that is contained in the final detergent composition.

Examples of particulate detergent components that can suitably be mixed into the thixotropic liquid mixture include enzyme, bleach, surfactant, silica, bleach activator, bleach catalyst, dispersing polymer, glass corrosion inhibitor, carbonate salt, silicate salt and combinations thereof.

According to a particularly preferred embodiment, the method comprises the addition of citric acid and/or sulphuric acid before the admixing of the one or more particulate detergent components, even more preferably before the mixing of the water-soluble surfactant with the liquid mixture.

Methodology for Determining Particle Size Distribution

The diameter of the suspended particles in the detergent composition is suitably determined by evaluation of a thin film by Light Microscopy using polarized light.

A Light Microscope (LM) gives 2-D projected images of particles (3-D objects). An equivalent circle diameter is measured. This is the diameter of a circle having the same area as the particle. The area is the number of pixels within the detected particle, which is straightforwardly determined by counting. This is done using binary image analyses as described in Russ (The Image Processing Handbook, $6^{th}$ edn. (2011), CRC Press, Florida, USA, p. 395-546 (Chapter 7: Segmentation and thresholding, chapter 8: Processing binary images and chapter 9: Image measurements). This method includes thresholding, separation of touching particles and measurement (counting).

Apparatus and Equipment:

- Light Microscope: Zeiss Axiophot equipped with linear polarization filter
- PC with operating system XP and fire wire card
- Digital camera with image acquisition software Sample Preparation:

- One droplet of the composition is put on a microscope slide.
- A cover glass is placed over the sample on the microscope slide without shear.
- To make a thin film of the sample, another microscope slide is positioned at the left side of the prepared sample at an angle of 45°.
- The cover glass is pressed with two fingers on the left side to prevent shear. By moving and pressing this microscope slide from left to right a thin film is created.

Microscopy:

- Use objective 10× (Image width: 300 μm).
- Focus sample through ocular or via camera on screen.
- Turn diaphragm to minimal and adjust to focus edge of diaphragm ring.
- Turn diaphragm open until just out of view.
- Push Polarisation Filter Analyser to LEFT position.
- Adjust light intensity with filters and/or light dosing ring until picture is clear.
- Make picture Image Analysis:

To distinguish the particles in the composition, a binary image is prepared by defining a range of brightness values in the grey scale image belonging to the foreground (particles) and rejecting all of the other pixels to the background. This operation is called "thresholding" and is a common way to segment a grey-value image in a binary image. The brightness of each pixel in a digital image is represented by an integer value called the grey level, which ranges from 0 to 255 (8-bit). Thresholding is one of the image processing steps required to measure the size of the particles observed in images. In this case automatic thresholding is used (isodata). Additional steps are needed to separate touching objects (Watershed of the Eucledian distance transform) and to select those to be measured.

The invention is further illustrated by means of the following non-limiting examples.

EXAMPLES

Example 1

Premixes 1-4 comprising GLDA, sodium cumene sulfonate (SCS) or sodium xylene sulfonate (SXS), citric acid and water were prepared on the basis of the formulations presented in Table 1 (all percentages by weight).

TABLE 1

| | | GLDA | Water | SCS/SXS |
|---|---|---|---|---|
| Premix 1 | | | | |
| Dissolvine ™ GL 47-S[1)] (47%) | 67.24% | 31.60% | 35.64% | |
| Citric acid (50%) | 2.76% | | 1.38% | |
| Dissolvine ™ PD-S[2)] (80%) | 30.00% | 24.00% | 6.00% | |
| SCS (40%) | 0.00% | | 0.00% | 0.00% |
| Total | 100.00% | 55.60% | 43.02% | 0.00% |
| Premix 2 | | | | |
| Dissolvine ™ GL 47-S[1)] (47%) | 59.77% | 28.09% | 31.68% | |
| Citric acid (50%) | 2.74% | | 1.37% | |
| Dissolvine ™ PD-S[2)] (80%) | 32.50% | 26.00% | 6.50% | |
| SCS (40%) | 4.99% | | 2.99% | 2.00% |
| Total | 100.00% | 54.09% | 42.54% | 2.00% |
| Premix 3 | | | | |
| Dissolvine ™ GL 47-S[1)] (47%) | 54.30% | 25.52% | 28.78% | |
| Citric acid (50%) | 2.69% | | 1.35% | |
| Dissolvine ™ PD-S[2)] (80%) | 33.00% | 26.40% | 6.60% | |
| SCS (40%) | 10.01% | | 6.01% | 4.00% |
| Total | 100.00% | 51.92% | 42.73% | 4.00% |
| Premix 4 | | | | |
| Dissolvine ™ GL 47-S[1)] (47%) | 59.77% | 28.09% | 31.68% | |
| Citric acid (50%) | 2.74% | | 1.37% | |
| Dissolvine ™ PD-S[2)] (80%) | 32.50% | 26.00% | 6.50% | |
| SXS (40%) | 5.00% | | 3.00% | 2.00% |
| Total | 100.01% | 54.09% | 42.55% | 2.00% |

[1,2)]AkzoNobel, The Netherlands

A microscopic image (light microscopy, polarized light, image width is 700 μm) of Premix 2 is shown in FIG. 1. This image shows that the SCS-containing particles have formed in the premix.

The liquid premixes were prepared by adding citric acid to Dissolvine™ GL 47-S at ambient temperature. Subsequently Dissolvine™ PD-S and the water-soluble surfactant were admixed to the Dissolvine™ solution under stirring.

The viscosity profiles of premixes 1, 2 and 3 were determined by measuring the viscosity while increasing the shear stress to 800 Pa. For premix 1 the viscosity was found to be constant at about 9 Pa·s. For premix 2 the initial viscosity was about 10,000 Pa·s and dropped to less than 100 Pa·s when the shear stress exceeded 100 Pa. For premix 3 the initial viscosity was more than 100,000 Pa·s and dropped to less than 100 Pa when the shear stress exceeded 200 Pa.

Next, liquid detergent formulations were prepared by adding bleach component and enzyme under stirring on the basis of the formulation presented in Table 2.

TABLE 2

| | |
|---|---|
| Premix | 88% |
| Percarbonate[1] | 10% |
| Protease[2] | 2% |
| Total | 100% |

[1]coated sodium percarbonate (ex Kemira)
[2]enzyme granulate (ex Dupont)

Stability Tests

A 250 ml plastic graduated cylinder (internal diameter of 38-40 mm) was filled with the formulation to the 250 ml stripe, closed with parafilm and left standing in a room of 25° C. for 24 hrs.

Segregation was measured by noting the volume of particles floating on the top or lying on the bottom after 24 hours under ambient conditions. The results are presented in Table 3.

TABLE 3

| Formulation | Percarbonate segregation (bottom) | Enzyme segregation (top) |
|---|---|---|
| 1 | 15 ml | 5 ml |
| 2 | 0 ml | <1 ml |
| 3 | 0 ml | 0 ml |
| 4 | 0 ml | 0 ml |

Flowability

In order to determine flowability of formulations 1-4, these formulations were put into a plastic funnel. The funnel had a total height of 9 cm, contained a cylindrical outlet having a height of 2.5 cm and an internal diameter of 2.2 cm. The outlet is connected to a conical receptacle with a height of 6.5 cm and a maximum internal diameter of 9.5 cm.

68 g+/−2 gr of each of the formulations was introduced in the aforementioned funnel after it had been placed in a glass beaker with the funnel outlet resting on the bottom of the beaker. After the product had been left for 1 minute, it was raised 10 cm above the bottom of the glass beaker and left there for 10 minutes to allow the product to flow out. After the 10 min the funnel is weighed and it is calculated how much product has flown out of the funnel.

The results are presented in Table 4.

TABLE 4

| Formulation | Percentage flown out |
|---|---|
| 1 | 93% |
| 2 | 87% |
| 3 | 63% |
| 4 | 94% |

Example 2

Premix Preparation

Premixes comprising methyl-glycine diacetate (MGDA) or iminodisuccinic acid (IDS), sodium cumene sulfonate (SCS), silica, glycerol and water were prepared on the basis of the formulations presented in Tables 5 and 6 (all percentages by weight).

TABLE 5

| | | MGDA | Water | SCS |
|---|---|---|---|---|
| MGDA (40%) | 80.92% | 32.37% | 48.55% | |
| Sorbosil TC15[3] | 3.99% | | | |
| SCS (40%) | 15.09% | | 9.05% | 6.03% |
| Total | 100.00% | 32.37% | 57.61% | 6.03% |

TABLE 6

| | | IDS | Water | SCS |
|---|---|---|---|---|
| IDS (75%) | 44.61% | 33.46% | 11.15% | |
| Water | 32.46% | | 32.46% | |
| Sorbosil TC15[3] | 1.71% | | | |
| SCS (40%) | 11.02% | | 6.61% | 4.41% |
| Pricerine (glycerol) | 10.19% | | | |
| Total | 100.00% | 33.46% | 50.23% | 4.41% |

Silica, available from PQ Corp.

Next, liquid detergent formulations were prepared by adding enzyme under stirring on the basis of the formulation presented in Table 7.

TABLE 7

| | Formulation | |
|---|---|---|
| | 1 | 2 |
| Premix | 96% MGDA | 96% IDS |
| Protease[2] | 4% | 4% |
| total | 100% | 100% |

[2]Enzyme granulate ex. Dupont

Stability tests were performed as described in Example 1. No enzyme segregation was observed.

In addition, the flowability of the formulations was determined using the funnel test described in Example 1. The results are depicted in Table 8.

TABLE 8

| Formulation | Percentage flown out |
|---|---|
| 1 | 79% |
| 2 | 65% |

The invention claimed is:

1. A pourable, thixotropic detergent composition comprising:

a) a continuous phase comprising:
   i) 10 wt. % of an aminocarboxylate chelant; and
   ii) at least 10 wt. % of water; and b) at least 0.3 wt. % of suspended particles comprising an aryl sulfonate water-soluble surfactant.

2. Composition according to claim 1, wherein the weight ratio of aminocarboxylate chelant to water lies within the range of 2:5 to 5:1.

3. Composition according to claim 1, wherein the aminocarboxylate chelant is selected from glutamic-N,N-diacetate (GLDA), methylglycinediacetic acid (MGDA), iminodisuccinic acid (IDS) and combinations thereof.

4. Composition according to claim 3, wherein the aminocarboxylate chelant is GLDA.

5. The composition according to claim 1 wherein the aryl sulfonate surfactant is an alkyl phenyl sulfonate surfactant.

6. The composition according to claim 5, wherein the alkyl phenyl sulfonate surfactant is selected from the group consisting of cumene sulfonate, xylene sulfonate, toluene sulfonate and combinations thereof.

7. Composition according to claim 1, wherein the composition contains 0.5-40 wt. % of the water-soluble surfactant.

8. Composition according to claim 1, wherein the composition further comprises 0.5-5.0 wt. % silica.

9. Composition according to claim 1, wherein the composition has a water activity of not more than 0.85.

10. Composition according to claim 1, wherein aminocarboxylate chelant and water together represent at least 60% by weight of the continuous phase.

11. Composition according to claim 1, wherein the composition further comprises at least 1 wt. % of transiently suspended particles.

12. Composition according to claim 11, wherein the transiently suspended particles comprise one or more detergent ingredients selected from the group consisting of enzyme, bleach, surfactant, silica, bleach activator, bleach catalyst, dispersing polymer, glass corrosion inhibitor, carbonate salt, silicate salt and combinations thereof.

13. Composition according to claim 1, wherein the composition, when added to demineralised water having a temperature of 20° C. in a concentration of 1 g per 100 ml of water, yields an aqueous solution having a pH of 7-13.

14. A method of preparing a composition according to claim 1, said method comprising:

a. Providing a liquid mixture containing water and aminocarboxylate chelant;

b. mixing water-soluble surfactant with the liquid mixture to produce a thixotropic liquid mixture; and c. optionally, mixing one or more particulate detergent components into the thixotropic liquid mixture.

* * * * *